US007458126B2

(12) United States Patent
Gueret

(10) Patent No.: US 7,458,126 B2
(45) Date of Patent: Dec. 2, 2008

(54) APPLICATOR FOR APPLYING A SUBSTANCE TO NAILS

(75) Inventor: Jean-Louis Gueret, Paris (FR)

(73) Assignee: L'Oreal (FR)

( * ) Notice: Subject to any disclaimer, the term of this patent is extended or adjusted under 35 U.S.C. 154(b) by 162 days.

(21) Appl. No.: 10/682,126

(22) Filed: Oct. 9, 2003

(65) Prior Publication Data

US 2004/0096261 A1 May 20, 2004

Related U.S. Application Data

(60) Provisional application No. 60/447,008, filed on Feb. 13, 2003.

(30) Foreign Application Priority Data

Oct. 10, 2002 (FR) ..... 02 12586

(51) Int. Cl.
*A45D 29/18* (2006.01)

(52) U.S. Cl. ..... 15/167.3; 15/143.1; 15/167.1; 15/160; 15/191.1; 401/129

(58) Field of Classification Search ..... 15/143.1, 15/167.3, 167.1, 160, 191.1; 401/126–130; 132/73, 218

See application file for complete search history.

(56) References Cited

U.S. PATENT DOCUMENTS

| | | | |
|---|---|---|---|
| 4,841,996 | A | 6/1989 | Gueret |
| 5,588,447 | A | 12/1996 | Gueret |
| 6,033,143 | A | 3/2000 | Gueret |

FOREIGN PATENT DOCUMENTS

| | | |
|---|---|---|
| DE | 199 12 004 | 9/2000 |
| FR | 0 651 955 B1 | 10/1994 |
| JP | 4-28812 | 9/1992 |
| JP | 9-238741 | 9/1997 |
| JP | 11-244041 | 9/1999 |
| JP | 2002-085151 | 3/2002 |

OTHER PUBLICATIONS

French Preliminary Examination Report.

*Primary Examiner*—Shay L Karls
(74) *Attorney, Agent, or Firm*—Lerner, David, Littenberg, Krumholz & Mentlik, LLP

(57) ABSTRACT

An applicator for applying a substance to nails is disclosed. The applicator comprises a rod having an end portion, the end portion having a housing, the housing having an opening of oblong cross-section with a long axis, the rod having a wall of varying thickness around the housing. In the end portion, the rod has a cross-section having an outer contour that is not concave, with the exception of one or more grooves situated opposite each other.

28 Claims, 2 Drawing Sheets

APPLICATOR FOR APPLYING A SUBSTANCE TO NAILS

CROSS REFERENCE TO RELATED APPLICATIONS

The present application claims priority of French Application No. 02 12586 filed Oct. 10, 2002 and claims the benefit of U.S. Provisional Application No. 60/447,008 filed Feb. 13, 2003, the teachings of which are incorporated herein by reference.

FIELD OF THE INVENTION

The present invention relates to an applicator for applying a substance, for example, nail varnish, to nails.

BACKGROUND OF THE INVENTION

A nail varnish applicator is known from European patent EP 0 651 955, comprising a rod, and bristles fixed in a housing of the rod, the housing being of oblong cross-section. In the examples shown in that patent, the opening of the housing has in cross-section a contour that matches the contour of the rod in the shape of a kidney or with two main sides slightly concave outwardly, such that the thickness of the wall surrounding the housing is constant.

A nail varnish applicator is also known from JP-4-28812, having a rod that includes a plurality of longitudinal grooves distributed in substantially uniform manner over its entire periphery.

SUMMARY OF THE INVENTION

A need exists to facilitate applying a substance such as nail varnish and to enable it to be spread more precisely. The Applicant has observed that with known applicators, the substance which flows along the rod and reaches the sides of the brush is relatively difficult to spread with precision.

According to one or more embodiments of the present invention, an applicator comprises a rod and bristles fixed in a housing of an end portion of the rod, the housing having an opening of oblong cross-section with a long axis X, and the rod having a wall of varying thickness around the housing.

In one aspect of the invention, in the end portion of the applicator including the housing that receives the bristles of the brush, the rod has a cross-section having an outer contour that is not concave, with the exception of one or more grooves situated opposite each other. The groove(s) extend along at least a portion of the rod and are situated substantially midway along the long axis X of the housing when the rod is observed in cross-section. According to certain embodiments, the outer contour of the rod may be convex and, where appropriate, it may include at least one flat side.

In one or more embodiments of the invention, the thickness or depth around the rod of the substance for application is greater in the groove(s) than on the sides. According to these embodiments, the substance which flows along the rod when the applicator is removed from the receptacle thus reaches the bundle of bristles preferentially in a substantially central region of said bundle, so that the substance can be spread under good conditions. The quantity of substance reaching the sides of the brush is small.

As mentioned above, the rod may include a second groove, opposite the first, and the applicator may be symmetrical about a mid plane. The two grooves can thus be symmetrical about a mid-plane parallel to the long axis X, but it is within the scope of the present invention for the grooves to be of different shapes.

In certain embodiments, the opening of the housing may advantageously have a cross-section that is substantially rectangular, thereby enabling a substantially uniform distribution of substance on the bristles to be obtained, but other shapes are within the scope of the present invention, for example, an oval cross-section.

According to one or more embodiments, in cross-section, the end portion of the rod may have two opposite sides that are outwardly convex, for example, in the shape of circular arcs, each connecting one of the sides including a groove to the opposite side. In cross-section, the or each groove may have a contour in the shape of a circular arc, for example.

In other embodiments, the housing may have a cross-section that tapers progressively towards its end wall, said taper matching the divergence desired for the bristles. The end wall of the housing may include a recess in which the bristles are fixed, and which opens out into a portion of the housing which flares out towards the opening of the housing, the portion enabling the bristles to splay apart from one another so as to impart a wider shape to the brush.

In certain embodiments, the housing may be arranged so that the bristles extend outside the housing over a width, measured parallel to the long axis X, that is greater than the width of the rod at the housing. A relatively wide brush is thus obtained.

According to some embodiments, the length of the portion of the bristles which projects from the housing of the rod can lie in the range of about 5 millimeters (mm) to about 20 mm, for example. In certain embodiments, the free ends of the bristles may substantially describe an arc of a circle, having a radius of curvature lying in the range of about 2 mm to about 15 mm, for example, and in particular in the range of about 4 mm to about 10 mm. According to certain embodiments, the width of the opening of the housing, measured perpendicularly to the long axis X, may be no greater than about 2 mm.

Close to the longitudinal ends along the long axis X of the housing, the walls of the rod may be relatively thin. Thus, in an embodiment of the invention, the rod may have a wall thickness around the housing that is smaller when measured at a longitudinal end of the housing than when measured mid-way along the housing.

Still in a particular embodiment, the thickness of the wall extending around the housing passes through a minimum in the portions that are adjacent to the longitudinal ends of the long axis of the housing. In another particular embodiment, at its widest point, the portion of the rod that is immersed in the substance contained in the receptacle when the applicator is in place on said receptacle may be no greater than to 5 mm. In certain embodiments, the rod may be arranged so as to be fixed to a closure cap of the receptacle; in a variant, the rod may be made in a single integral piece with a closure cap of the receptacle, by molding plastics material.

BRIEF DESCRIPTION OF THE DRAWINGS

The invention will be better understood on reading the following detailed description of non-limiting embodiments thereof, and on examining the accompanying drawings, in which.

DETAILED DESCRIPTION

Before describing several exemplary embodiments of the invention, it is to be understood that the invention is not limited to the details of construction or process steps set forth in the following description. The invention is capable of other embodiments and of being practiced or carried out in various ways.

Figure 1:
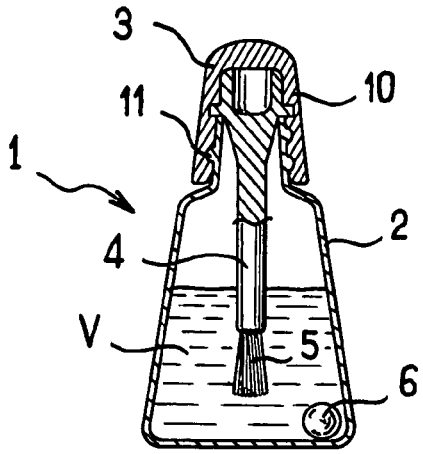
FIG. 1 is a side, elevational, cross-sectional view of a device in accordance with one embodiment of the present invention for applying a substance to the nails.

FIG. 1 shows an exemplary embodiment of a device 1 for applying a substance to the nails, for example, a nail varnish V, the device comprising a receptacle 2 containing the varnish V, and an applicator 3 comprising a rod 4 made of plastics material, provided at one end with a flat brush 5, and at the other end with a handle member 10 also constituting a closure cap of the receptacle 2. In the embodiment shown in FIG. 1, the receptacle 2 also contains a bead 6, e.g. a metal ball-bearing, enabling the varnish V to be homogenized before application, by shaking the device 1.

Figure 2:
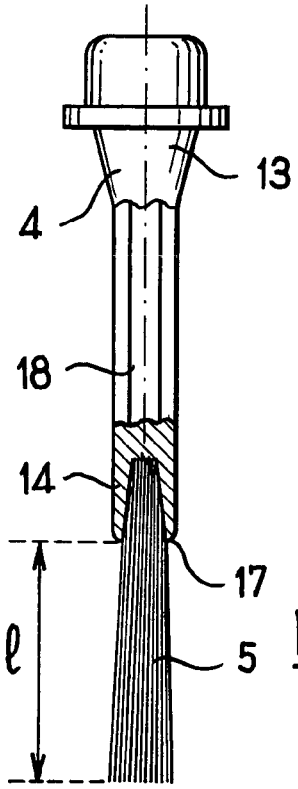
FIG. 2 is a side, elevational, cross-sectional fragmentary view of the applicator shown in the device of FIG. 1.
Figure 3:
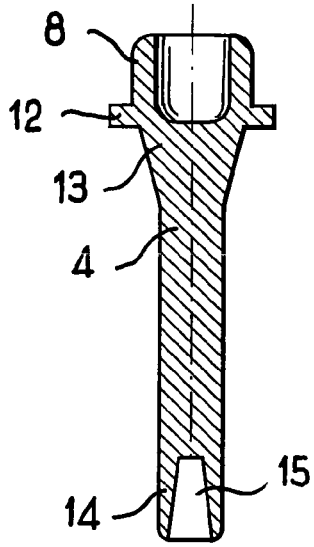
FIG. 3 is a side, elevational, cross-sectional view of the rod of the applicator shown in FIG. 1.

In FIGS. 1 to 3, it can be seen that the top end of the rod 4 has a skirt 8 enabling it to be fixed in a housing of the cap 10, said cap being configured so as to be screwed onto the neck 11 of the receptacle 2. A collar 12 is formed at the base of the skirt 8 so as to bear against the top edge of the neck 11 when the applicator is in place on the receptacle 2.

Beneath the collar 12, the rod 4 includes a cone-shaped portion 13 suitable for contributing to sealing the closure of the receptacle 2 when the applicator 3 is in place on said receptacle. Sealing could also be obtained through cooperation between the surface of the cap 10 and of the neck of the receptacle. The rod 4 also includes a bottom end portion 14 which is provided with a housing 15 inside which the bristles of the brush 5 are held, e.g. by stapling, gluing, heat sealing, or overmolding.

Figure 4:
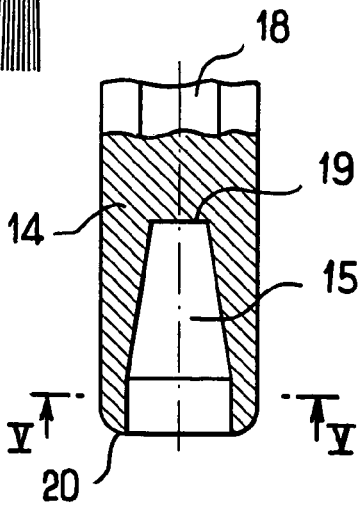
FIG. 4 shows a detail of the housing receiving the bristles of the brush.

As can be seen in FIG. 4, the free end of the rod 4 may be beveled at 20. In the example shown, the rod 4 includes two opposite longitudinal grooves 18 extending along a major fraction of its length up to its distal end 17. In the embodiment shown, the housing 15 has an opening of rectangular cross-section of elongate shape with a long axis X perpendicular to the longitudinal axis of the rod 4. In the embodiment under consideration, the outside contour of the rod 4 and the housing 15 are symmetrical about the axis X and about a mid-axis Y perpendicular to the axis X.

Figure 5:
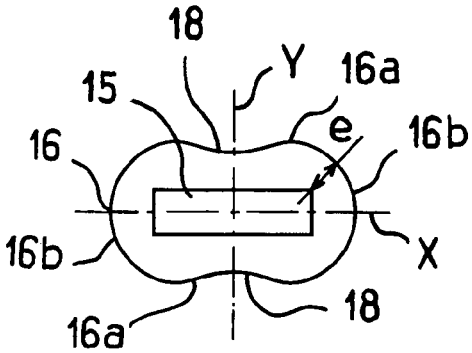
FIG. 5 is a side, elevational, cross-sectional partial view taken along section V-V in FIG. 4.

It can be seen in FIG. 5 that the wall thickness of the material surrounding the housing 15 is not constant. Apart from the grooves 18, the outside contour 16 of the rod 4 is convex, when said rod is observed in cross-section. More particularly, in the embodiment under consideration, the contour of the rod 4 is defined in the grooves 18 by circular portions 16*a*, the portions 16*a* being united at their ends by circular portions 16*b* that are outwardly convex and that are of smaller radius of curvature than the portions 16*a*.

As can be seen in FIG. 4, the housing 15 can have a cross-section which tapers towards the end wall 19 of the housing. The bristles of the brush 5 splay apart when the brush is applied to a nail. Depending on the shape of the housing 15, a narrower or wider bundle of bristles can be obtained, as shown in FIGS. 13 and 14.

Figure 13:
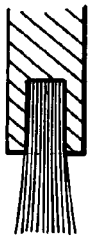
FIG. 13 shows a variant configuration of the housing, showing a different distribution of the bristles outside the rod.

It can be seen in FIG. 13 that by providing a housing 15 with a substantially constant cross-section, a brush is obtained having bristles that are relatively close together, whereas by providing the housing 15 with an outwardly flaring shape, the bristles are able to splay further apart from one another so as to form a relatively wide bundle.

In its end wall, the housing 15 can be made with a recess 15*a* in which the bristles are secured to the rod. The recess 15*a* can open out into a portion 15*b* which flares out towards the open end of the housing 15, enabling the bristles to splay apart from one another.

Figure 14:
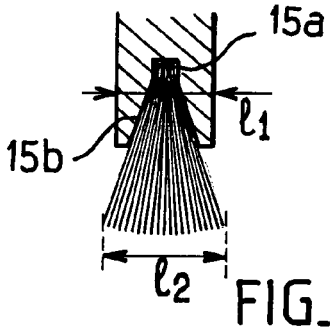
FIG. 14 shows a variant configuration of the housing, showing a different distribution of the bristles outside the rod.

As can be seen in FIG. 14, the housing 15 can thus be made in such a manner that the maximum transverse dimension $l_2$ of the brush, measured parallel to the long axis X, is greater than the transverse dimension $l_1$ of the rod at the housing 15.

Figure 15:
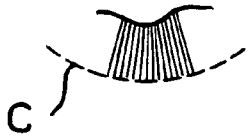
FIG. 15 shows, in isolation, an end portion of the bristles of the brush.

As can be seen in FIG. 15, the free ends of the bristles of the brush 5 can be situated along a substantially circular curve C, for example. In a variant, the free ends of the bristles could be situated substantially along a straight line, for example. The length l of the portion of the bristles which projects from the housing 15 lies in the range of about 5 mm to 20 mm, for example.

The device 1 can be used as follows. The user shakes the receptacle 2 so as to enable the bead to homogenize the varnish V, and then the user unscrews the cap 10 and uses the brush 5 to apply the varnish.

When the applicator 3 is removed from the receptacle 2, substance is present on the rod 4 and said substance flows by gravity towards the brush 5. The thickness or depth of substance is greater in the grooves 18, which can retain more substance by capillarity. The substance preferably flows into the central region of the brush, thereby enabling it to be spread more easily and more precisely.

It will be understood of course that the invention is not limited to the embodiment described above. In particular, it is possible to modify the shape of the housing and/or the shape of the end portion of the rod in which said housing is made. By way of example, FIGS. 6 to 12 show various, non limited examples of possible shapes of the housing, from among other possible shapes.

Figure 6:
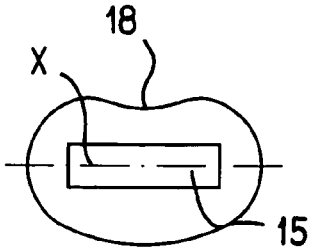
FIG. 6 is a sectional view on V-V of variant embodiment of the end portion of the rod.
Figure 7:
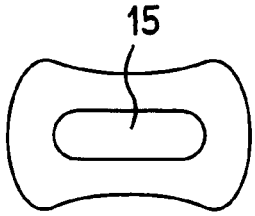
FIG. 7 is a sectional view on V-V of variant embodiment of the end portion of the rod.
Figure 8:
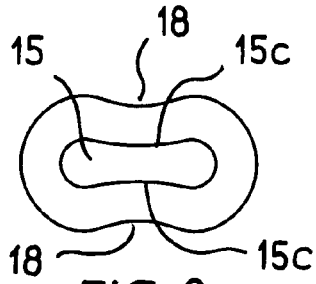
FIG. 8 is a sectional view on V-V of variant embodiment of the end portion of the rod.

It can be seen in FIG. 6 that the rod can include a single groove 18 only. It can be seen in FIG. 7 that the opening of the housing can have a cross-section that is not rectangular but oblong, e.g. elliptical. It can be seen in FIG. 8 that the opening of the housing can have a cross-section having two slight concavities 15*c* in its long sides, the two concavities being less pronounced, however, than the concavities formed by the grooves 18.

Figure 9:
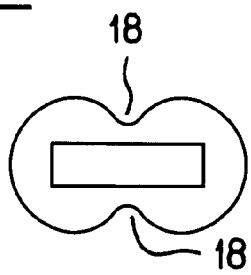
FIG. 9 is a sectional view on V-V of variant embodiment of the end portion of the rod.
Figure 10:
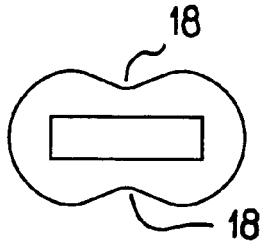
FIG. 10 is a sectional view on V-V of variant embodiment of the end portion of the rod.
Figure 11:
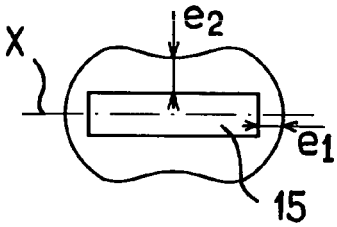
FIG. 11 is a sectional view on V-V of variant embodiment of the end portion of the rod.
Figure 12:
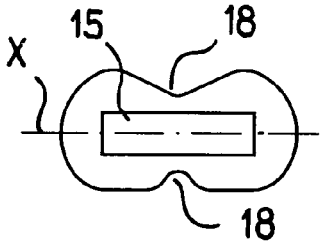
FIG. 12 is a sectional view on V-V of a variant embodiment of the end portion of the rod.
Figure 16:
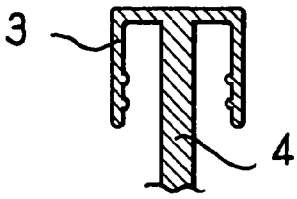
FIG. 16 is a fragmentary longitudinal section of the rod made integrally with a cap.

It can be seen in FIG. 9 that the grooves 18 can be relatively narrow, so as to increase further the retention of substance by capillarity, for example. It can be seen in FIG. 10 that the grooves 18 can have a triangular profile in cross-section. FIG. 11 illustrates the fact that the wall thickness $e_1$ in the vicinity of the longitudinal ends of the housing 15 can be smaller than the wall thickness $e_2$ substantially mid-way along the housing 15. If necessary, the thickness $e_1$ can correspond to a minimum. A small thickness $e_1$ enables a housing 15 to be made to be longer along the long axis X, thereby enabling a brush to be obtained that is very wide or that is capable of widening easily. FIG. 12 shows the possibility of having two grooves 18 of different shapes. The rod 4 can also be made in a single integral piece with the closure cap of the receptacle, as shown in FIG. 16.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims and their equivalents.

What is claimed is:

1. An applicator for applying a substance to nails, comprising:

a rod having an end portion including a housing and an opening to said housing formed therein, said housing and said opening having an elongated transverse cross-section with a long axis, said housing having a plurality of corners in said transverse cross-section, said rod including a wall around said housing that varies in thickness in said transverse cross-section, a minimum distance between one of said corners and an outside surface of said wall defining a first wall thickness, and a distance along said long axis between a longitudinal end of said housing and said outside surface of said wall defining a second wall thickness greater than said first wall thickness, said rod having formed therein only one groove or only two grooves situated opposite each other, said only one groove or said only two grooves extending along at least a portion of said rod and being situated substantially mid-way along said long axis; and bristles fixed in said housing and having a portion projecting therefrom.

2. An applicator according to claim 1, wherein said only two grooves are symmetrical about a mid-plane parallel to said long axis.

3. An applicator according to claim 1, wherein said only two grooves have different shapes.

4. An applicator according to claim 1, wherein said opening of said housing has a substantially rectangular cross-section.

5. An applicator according to claim 1, wherein said rod has a first side and a second side opposite said first side, said only one groove being formed in said first side, and in cross-section, said end portion of said rod further comprises two opposite convex sides, each of said two opposite convex sides connecting said first side to said second side.

6. An applicator according to claim 1, wherein said housing extends from said opening to a closed end, and tapers progressively outwardly from said closed end towards said opening.

7. An applicator according to claim 1, wherein said housing extends from said opening to a closed end, said closed end including a recess in which said bristles are fixed, and wherein said housing flares out from said closed end towards said opening.

8. An applicator according to claim 1, wherein said portion of said bristles which projects from said housing has a length between about 5 mm and 20 mm.

9. An applicator according to claim 1, wherein said bristles comprise free ends that substantially describe an arc of a circle having a radius of curvature between about 2 mm and 15 mm.

10. An applicator according to claim 1, wherein said bristles comprise free ends that substantially describe an arc of a circle having a radius of curvature between about 4 mm and 10 mm.

11. An applicator according to claim 1, wherein the width of said opening of said housing, measured perpendicularly to said long axis, is not greater than about 2 mm.

12. An applicator according to claim 1, wherein said rod includes a portion intended to be immersed in a substance contained in a receptacle, said portion having a maximum width of not greater than 5 mm.

13. An applicator according to claim 1, wherein said wall has a third wall thickness measured mid-way along said long axis, said second wall thickness being less than said third wall thickness.

14. An applicator according to claim 1, wherein a minimum wall thickness of said rod is said first wall thickness.

15. An applicator according to claim 1, wherein said rod is adapted to be affixed to a closure cap of a receptacle.

16. An applicator according to claim 1, further including a closure cap for a receptacle, wherein said rod is integrally formed with said closure cap.

17. An applicator according to claim 16, wherein said rod and said closure cap are comprised of molded plastic material.

18. An applicator according to claim 1, wherein said bristles extend from said housing to an end having a first width measured parallel to said long axis, and said rod has a second width at said end portion measured parallel to said long axis, said first width being greater than said second width.

19. The applicator of claim 1, wherein said rod includes only one groove.

20. The applicator of claim 1, wherein said rod has only two grooves, a first side and a second side opposite said first side, one of said only two grooves being formed in said first side, and another of said only two grooves being formed in said second side.

21. The applicator of claim 20, wherein said only two grooves have substantially the same shape.

22. An applicator according to claim 1, wherein said only one groove or said only two grooves extend along a major fraction of the length of said rod up to a distal end of said rod.

23. An applicator according to claim 1, wherein said transverse cross-section at said end portion of said rod has a convex outer contour except at the location of said only one groove or said only two grooves, said convex outer contour having a first radius of curvature and said only one groove or said only two grooves having a second radius of curvature greater than said first radius of curvature.

24. An applicator according to claim 1, wherein said transverse cross-section at said end portion of said rod has a convex outer contour except at the location of said only one groove or said only two grooves, said convex outer contour having a first radius of curvature and said only one groove or said only two grooves having a second radius of curvature less than said first radius of curvature.

25. An applicator according to claim 1, wherein at least one of said grooves has a triangular profile in said transverse cross-section.

26. A device for applying a substance to nails, said device comprising a receptacle containing the substance to be applied, and an applicator as defined in claim 1.

27. An applicator for applying a substance to nails, comprising:

a rod having an end portion including a housing and an opening to said housing formed therein, said housing and said opening having an elongated transverse cross-section with a long axis, said rod including a wall around said housing that varies in thickness in said transverse cross-section, said rod having formed therein only two grooves situated opposite each other, said only two grooves being situated substantially mid-way along said long axis and having different shapes, said transverse cross-section at said end portion of said rod having a convex outer contour except at the location of said only two grooves; and bristles fixed in said housing and having a portion projecting therefrom.

28. An applicator for applying a substance to nails, comprising:

a rod having an end portion including a housing and an opening to said housing formed therein, said housing and said opening having an elongated transverse cross-section with a long axis, said rod including a wall around said housing that varies in thickness in said transverse cross-section, said wall having a first thickness at a longitudinal end of said transverse cross-section of said housing and a second thickness greater than said first thickness mid-way along said transverse cross-section of said housing, said rod having formed therein only one groove or only two grooves situated opposite each other, said transverse cross-section at said end portion of said rod having a convex outer contour except at the location of said only one groove or said only two grooves, said only one groove or said only two grooves extending along at least a portion of said rod and being situated substantially mid-way along said long axis; and bristles fixed in said housing and having a portion projecting therefrom.

* * * * *